US009688369B2

(12) United States Patent
Faletra

(10) Patent No.: US 9,688,369 B2
(45) Date of Patent: Jun. 27, 2017

(54) INFLATABLE LIFE RAFT ASSEMBLY

(71) Applicant: Troy Faletra, Fort Lauderdale, FL (US)

(72) Inventor: Troy Faletra, Fort Lauderdale, FL (US)

(73) Assignee: QUICK RAFT, LLC, Fort Lauderdale, FL (US)

( * ) Notice: Subject to any disclaimer, the term of this patent is extended or adjusted under 35 U.S.C. 154(b) by 0 days.

(21) Appl. No.: 14/457,928

(22) Filed: Aug. 12, 2014

(65) Prior Publication Data

US 2016/0046355 A1 Feb. 18, 2016

Related U.S. Application Data

(63) Continuation-in-part of application No. 13/312,657, filed on Dec. 6, 2011, now Pat. No. 9,162,738, which is a continuation-in-part of application No. 12/427,292, filed on Apr. 21, 2009, now Pat. No. 8,070,543.

(60) Provisional application No. 61/060,151, filed on Jun. 10, 2008.

(51) Int. Cl.
*B63C 9/04* (2006.01)

(52) U.S. Cl.
CPC ..... *B63C 9/04* (2013.01); *B63C 2009/042* (2013.01); *B63C 2009/048* (2013.01)

(58) Field of Classification Search
CPC ..... B63B 35/58; B63B 43/00; B63B 43/12; B63C 7/00; B63C 7/10; B63C 7/12; B63C 9/04; B63C 9/20; B63C 9/26; B63C 9/155; B63C 9/087; B63C 9/28
USPC ..... 441/38, 41, 42
See application file for complete search history.

(56) References Cited

U.S. PATENT DOCUMENTS 4,355,987 A * 10/1982 Miller ..... 441/41
6,080,027 A * 6/2000 Rodemann ..... 441/41
6,394,867 B1 * 5/2002 Bianco ..... B63C 9/04 114/360
2011/0177732 A1 * 7/2011 Clifford ..... B63C 9/065 441/38

* cited by examiner

*Primary Examiner* — Lars A Olson
(74) *Attorney, Agent, or Firm* — H. John Rizvi; Gold & Rizvi, P.A.

(57) ABSTRACT

An inflatable life raft assembly is disclosed, including a deployable and inflatable life raft that a user can voluntarily and repeatedly deploy from a storage carrier, inflate for use, and fold back into the container after use. The carrier is integrally formed with or permanently attached to the inflatable life raft. A compressed gas cylinder can assist the user in inflating the life raft. The storage carrier can automatically open when the life raft inflates, by pressure exerted from within the carrier by the expanding life raft. The inflatable life raft includes weight inserts to render the life raft assembly throwable, both when the life raft is folded and stored in the carrier, and when the life raft is deployed and inflated, greatly assisting a user in tossing or throwing the life raft to a person in need of a floating aid.

19 Claims, 13 Drawing Sheets

INFLATABLE LIFE RAFT ASSEMBLY

CROSS REFERENCE TO RELATED APPLICATIONS

This Continuation-In-Part Utility patent application claims the benefit of U.S. Non-Provisional patent application Ser. No. 13/312,657, filed on Dec. 6, 2011, which is a Continuation-In-Part Utility patent application claiming the benefit of U.S. Non-Provisional patent application Ser. No. 12/427,292, filed on Apr. 21, 2009, now U.S. Pat. No. 8,070,543, issued on Dec. 6, 2011, which claims the benefit of U.S. Provisional Patent Application Ser. No. 61/060,151, filed on Jun. 10, 2008, which is incorporated herein in its entirety.

FIELD OF INVENTION

The present invention relates to a floatation device, and more particularly, to an inflatable life raft assembly adaptable for recreational use or personal safety. The inflatable life raft assembly includes an inflatable life raft, and an integrally-formed or permanently attached storage carrier for storing the raft in a deflated, folded configuration for easily carrying, transportation, and unencumbered deployment the life raft.

BACKGROUND OF THE INVENTION

There are a variety of floatation devices available on the market today. Some examples of floatation devices include boats, rafts, mattresses, tubes, watercrafts and floats. Some of the floatation devices are formed from pressurized pontoons, shaped fiberglass, or a dense foam material designed to provide the requisite bouncy needed for the floatation device to remain afloat. Popular floatation devices known in the art include inflatable life rafts. Inflatable life rafts provide the advantages of being compact, inexpensive to purchase, lightweight, and easy to store and transport when deflated.

Generally, inflatable life rafts are designed for either recreational use or are adapted for emergency or rescue operations. Most inflatable life rafts used for recreational activities typically include inflatable rafts or mattresses that are fabricated from a plastic or other gas impervious material forming one or more inflatable chambers for receiving air or gas therein through an inflation valve. It is common that on many occasions, a user does not take the requisite time needed to adequately deflate the inflatable raft after use, resulting in the raft material rotting over time. In those occasions when a user does deflate the inflatable life raft, the user generally gathers the deflated raft together in a bundle making it difficult for storing, carrying and transporting the bulky raft. Most prior art inflatable rafts cannot be easily stored in a backpack, in luggage, hung in the closet, or conveniently transported effectively. In an emergency, the raft is not configured for a rapid and unencumbered deployment.

Often times when boating, some individuals feel nervous in relying only on a lift jacket. For some people a life jacket is just not enough. In the event of an emergency on the water, the life jacket does not offer the luxury of having life saving accessories available to the wearer. Further, in situations where only one floatation device is available to a plurality of people, such as a lifeboat, many individuals have difficulty swimming or simply cannot swim to a deployed lifeboat. Lifeboats tend to be bulky, expensive and permanently stored on a vessel.

Accordingly, there remains in the art a need for an inflatable life raft designed for recreational use, emergency use, or rescue operations where the inflatable life raft is inexpensive, and easy to inflate, to deflate, to store in a fully deflated state and to transport. In addition, the life raft should be able to be thrown in a selected direction, preferably in both the deflated and inflated states, in order for the raft to constitute a throwable floating aid for rescuing persons who are in risk of drowning.

SUMMARY OF THE INVENTION

The present invention overcomes the deficiencies of the known art and the problems that remain unsolved by providing an inflatable life raft assembly comprising a deployable and inflatable life raft that is reversibly and selectively deployed from a storage carrier and inflated for use. The carrier is integrally formed with or permanently attached to the inflatable life raft. The life raft can be folded back into the storage carrier for storage. A compressed gas cylinder can assist in inflating the life raft. The storage carrier can automatically open when the life raft inflates, by pressure exerted from within the carrier by the expanding life raft. The inflatable life raft includes weight inserts to render the life raft assembly throwable, both when the life raft is folded and stored in the carrier, and when the life raft is deployed and inflated, greatly assisting a user in tossing or throwing the life raft to a person in need of a floating aid.

In accordance with a first embodiment of the present invention, the invention consists of an inflatable life raft assembly comprising:

an inflatable life raft, comprising:

a plurality of chambers arranged in parallel configuration forming a generally rectangular shaped body when said life raft is in a deployed and inflated configuration, wherein said body can be reversibly altered from a deflated and folded configuration to said deployed and inflated configuration; and at least one valve in fluid communication with said chambers for inflating and deflating said chambers; and a storage carrier constructed integrally with or non-removably attached to a surface of said body, said storage carrier comprising:

a plurality of sidewalls delimiting a receptacle, said receptacle being configured to store said inflatable life raft body in said deflated and folded configuration;

at least one closure flap extending from a sidewall for selectively preventing or providing access to said receptacle, and at least one fastener for selectively and removably securing said closure flap in a closed position in which access to said receptacle is prevented.

In a second aspect, the storage carrier further comprises a handle, to facilitate storage, transportation and throwing of the life raft assembly.

In another aspect, the fastener includes at least one of a spring clip, zipper, buckle, strap, cord, hooks, clasps, carabiner, or any combination thereof, for easy and secure fastening and unfastening.

In another aspect, the at least one fastener is configured to unfasten upon a pressure exerted on said storage carrier by said life raft from within the receptacle when said life raft is inflating from said deflated and folded configuration, allowing for automatic carrier opening and deploying of the life raft.

In another aspect, the at least one fastener comprises at least one of a hook and loop fastener, a snap fastener, a magnet, a quick release fastener, or a combination thereof, facilitating automatic carrier opening and deploying of the life raft.

In another aspect, the life raft is fabricated from a resilient material composed of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

In another aspect, the life raft assembly further includes a tether connected to said body, said tether comprising a tether attachment to a user, to allow the user to attach his or her body to the life raft assembly for increased security.

In another aspect, the tether includes a tether strap, one end of said tether strap attached to said body, and a second end of said tether strap attached to an attachment for removably attaching said tether on a user's body part.

In another aspect, the life raft assembly further includes at least one reflector disposed on at least one side of said body, wherein said reflector is arranged closer to an edge of said side than to a center of said side.

In another aspect, the life raft includes a plurality of grommets disposed along an outside perimeter flap of said life raft, allowing to insert a rope therethrough, for increased security.

In another aspect, the life raft further includes a gas cylinder in selective fluid communication with said chambers.

In another aspect, the life raft further includes a manual air pump and/or manual inflator, in selective fluid communication with said chambers for manually inflating said life raft.

In another aspect, the inflatable life raft body comprises at least one weight insert arranged in transverse alignment with a chamber, to render the life raft assembly throwable.

Introducing another embodiment of the invention, the present invention consists of an inflatable life raft assembly comprising:

an inflatable and elastic life raft, reversibly and selectively alterable from a deflated and folded configuration to a deployed and inflated configuration, said life raft comprising at least one gas impervious chamber and at least one valve in fluid communication with said at least one gas impervious chamber for inflating and deflating said at least one chamber; and a storage carrier constructed integrally with or non-removably attached to a surface of said inflatable life raft, said storage carrier comprising:

- a plurality of sidewalls delimiting a receptacle, said receptacle being configured to store said inflatable and elastic life raft in said deflated and folded configuration;
- at least one closure flap extending from a sidewall for selectively preventing or providing access to said receptacle, and
- at least one fastener for selectively and removably securing said closure flap in a closed position in which access to said receptacle is prevented; wherein said at least one fastener is configured to unfasten upon a pressure exerted on said storage carrier by said life raft from within the receptacle when said life raft is inflating from said deflated and folded configuration.

Introducing yet another embodiment of the invention, the present invention consists of an inflatable life raft assembly comprising:

an inflatable and elastic life raft, reversibly and selectively alterable from a deflated and folded configuration to a deployed and inflated configuration, said life raft extending in longitudinal and lateral directions when in said deployed and inflated configuration, said life raft comprising:

- at least one gas impervious chamber configured to inflate and deflate in a transverse direction perpendicular to said longitudinal and lateral directions;
- at least one valve in fluid communication with said at least one gas impervious chamber for inflating and deflating said at least one chamber; and
- at least one weight insert arranged in transverse alignment with said chamber;

a storage carrier constructed integrally with or non-removably attached to a surface of said inflatable life raft, said storage carrier comprising:

- a plurality of sidewalls delimiting a receptacle, said receptacle being configured to store said inflatable and elastic life raft in said deflated and folded configuration;
- at least one closure flap extending from a sidewall for selectively preventing or providing access to said receptacle, and
- at least one fastener for selectively and removably securing said closure flap in a closed position in which access to said receptacle is prevented.

In a second aspect, the life raft comprises at least two flexible sheets joined and sealed together along an outer perimeter and along a plurality of longitudinal seams, end chambers being formed between a respective opposite portions of said outer perimeter and a respective adjacent seam, and intermediate chambers being formed between seams, wherein at least one weight insert is formed as a generally rectangular sheet portion embedded or adhered to at least one flexible sheet, in transverse alignment with a chamber.

In another aspect, all weight inserts are formed as generally rectangular sheet portions embedded or adhered to at least one flexible sheet, in transverse alignment with a chamber.

In another aspect, the life raft comprises at least two flexible sheets joined and sealed together along an outer perimeter and along a plurality of longitudinal seams, end chambers being formed between a respective opposite portions of said outer perimeter and a respective adjacent seam, and intermediate chambers being formed between seams, wherein said weight inserts are arranged in transverse alignment with said intermediate chambers, said end chambers being devoid of transversely-aligned weight inserts.

In another aspect, the life raft comprises at least two flexible sheets joined and sealed together along an outer perimeter and along a plurality of longitudinal seams, wherein at least one flexible sheet presents a higher density than a density of the rest of flexible sheets.

Regarding the embodiments described herein, as well as those covered by the claims, the inflatable life raft assembly may be constructed in different sizes and dimensions, and include one or more fluorescent colors. The storage carrier may include markings, letters, indicia, figures, characters, numbers, or the like disposed on the outer surface for identification. One or more pouches can be optionally included, shaped and sized to hold a variety of different small items or products, and may include a transparent or opaque covering.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
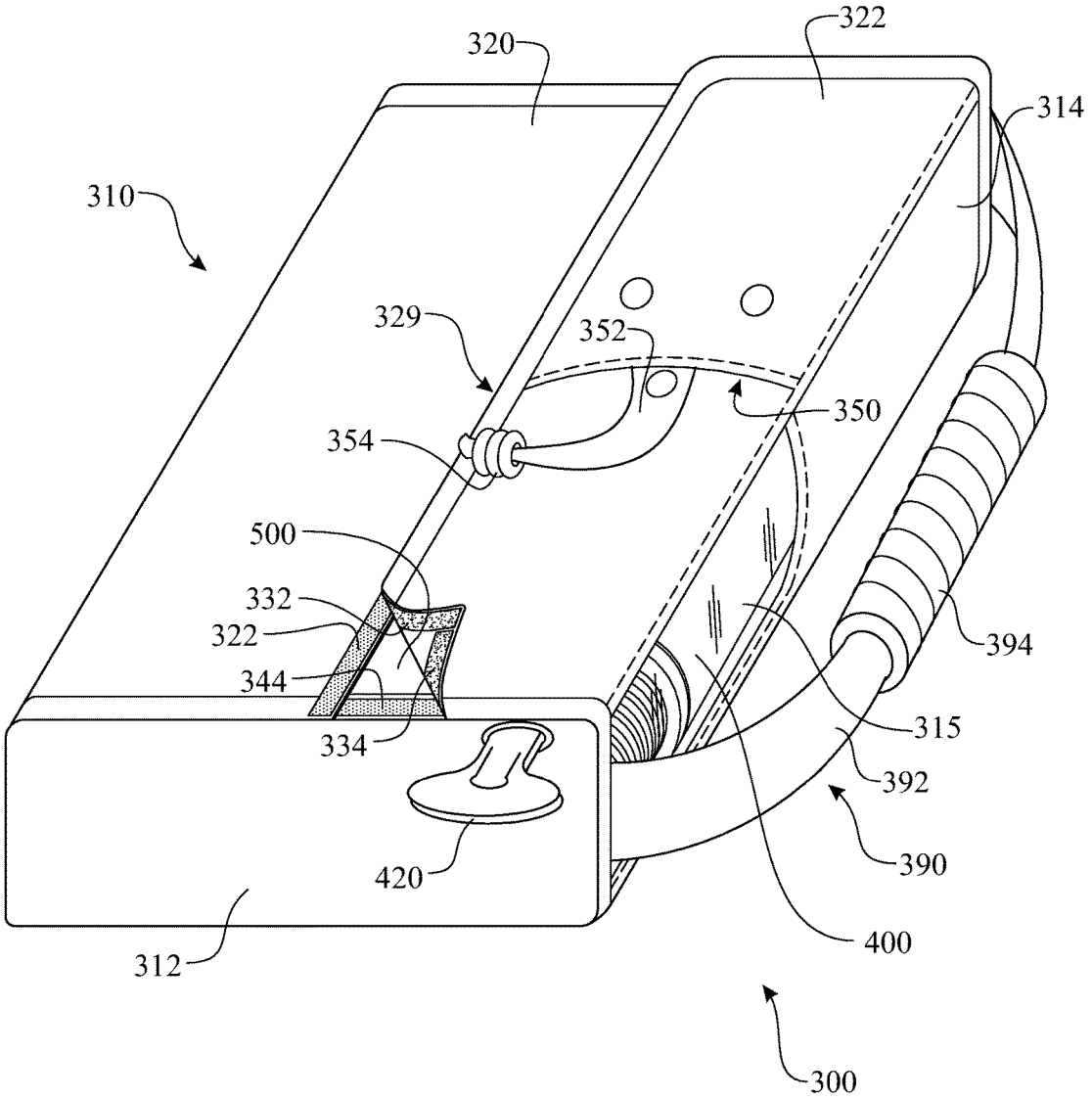
FIG. 1 presents an isometric view of an exemplary deployable inflatable life raft assembly in accordance with a first embodiment of the present invention, the assembly shown in a deflated, closed configuration.
Figure 2:
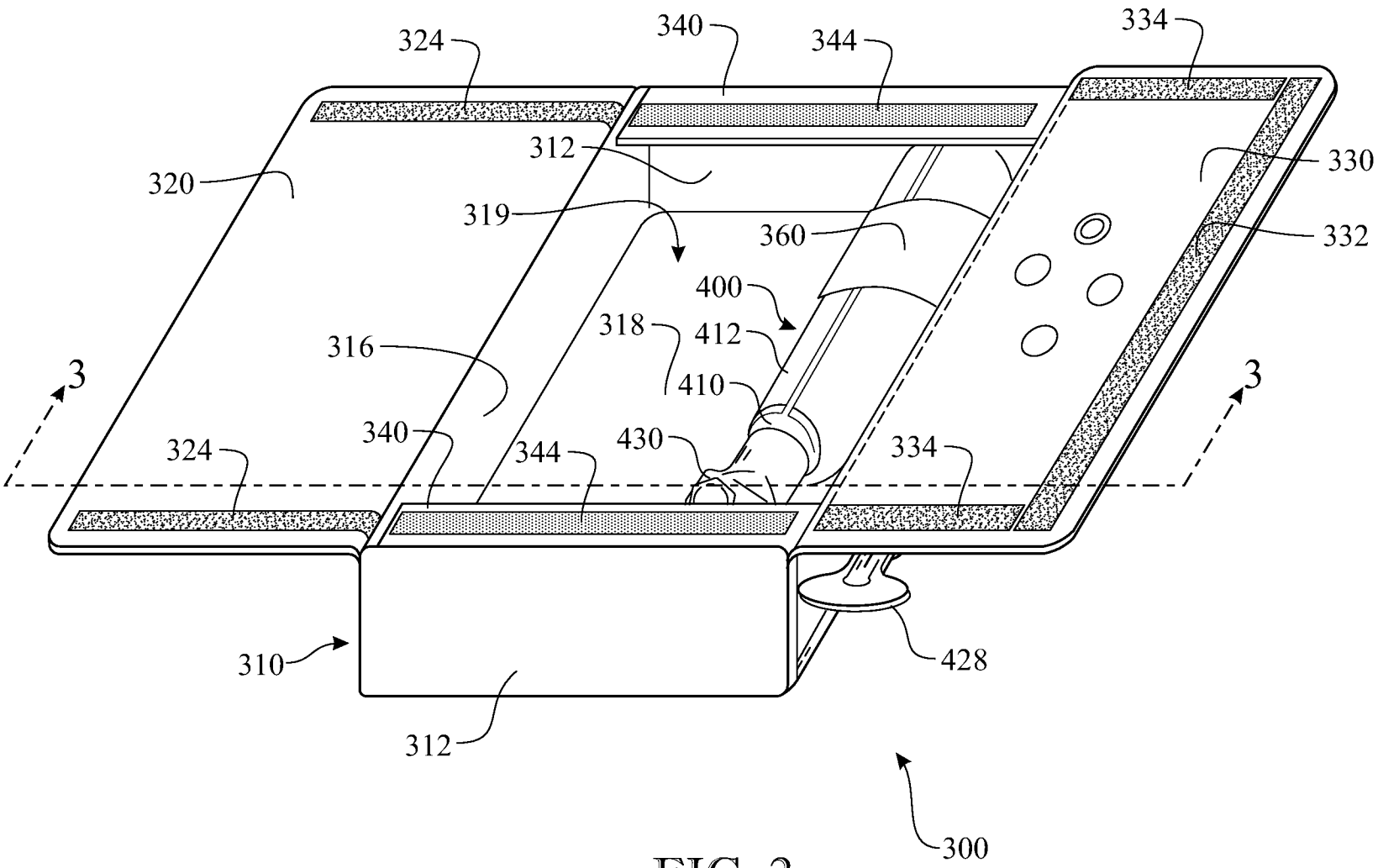
FIG. 2 presents an isometric view of the exemplary deployable inflatable life raft assembly originally introduced in FIG. 1, the assembly shown in a configuration in which the carrier is open, and in which the inflatable life raft has been excluded for clarity.
Figure 3:
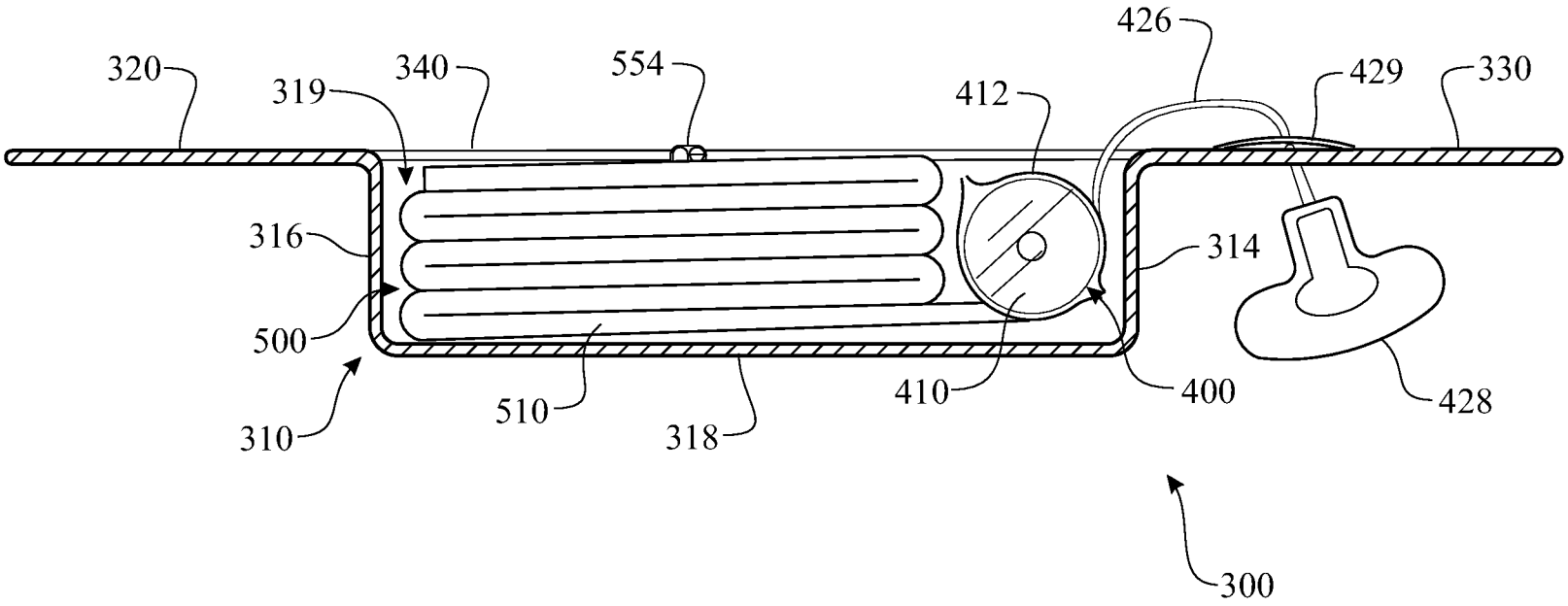
FIG. 3 presents a side section view of the exemplary deployable inflatable life raft assembly of FIG. 2, the section taken along section line 3-3 of FIG. 2, wherein the inflatable raft has been included in a folded and stored position inside the carrier.
Figure 4:
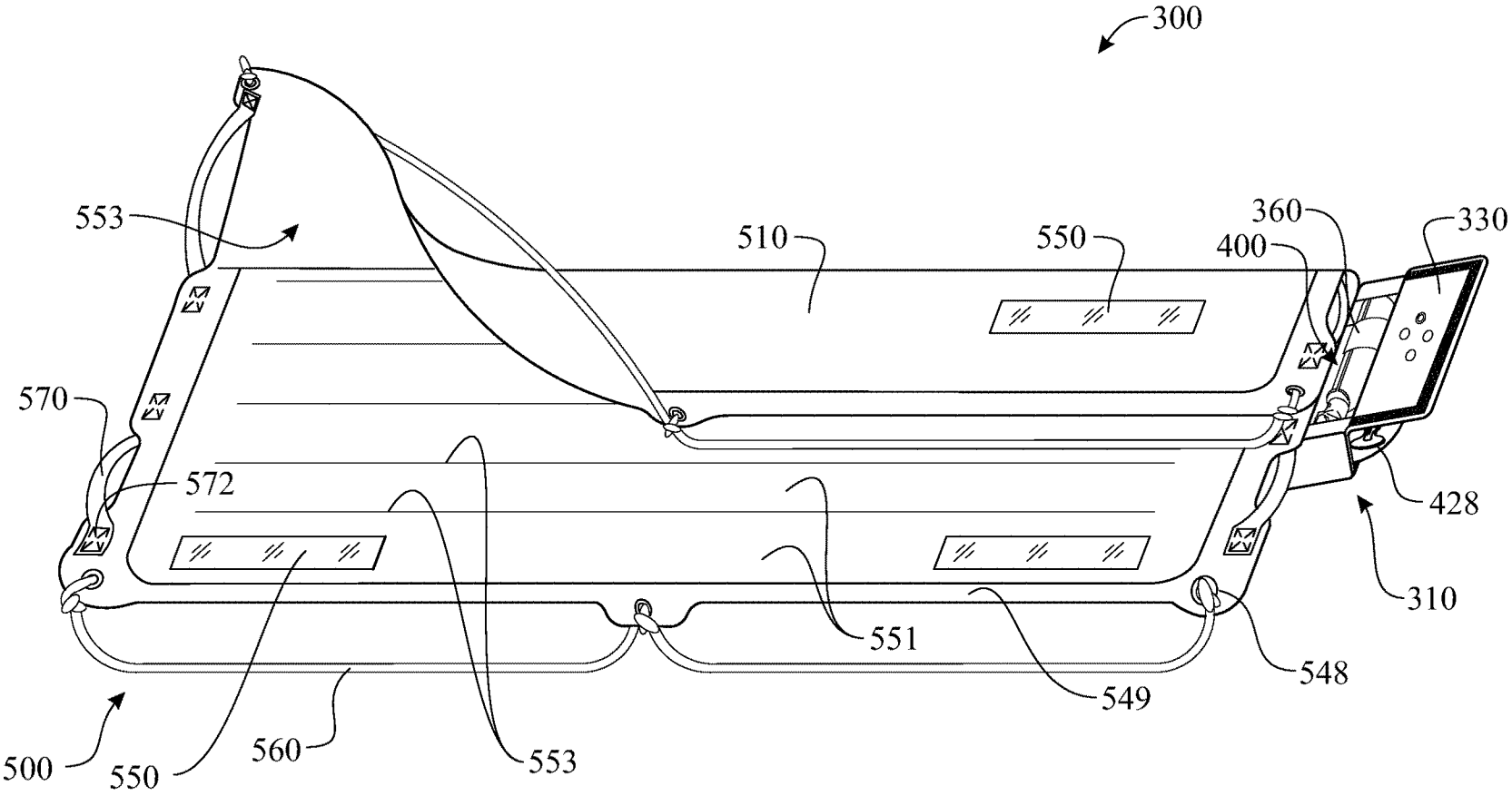
FIG. 4 presents an isometric view of the exemplary deployable inflatable life raft assembly, illustrating the inflatable life raft in a partially deployed configuration.

The illustration of FIGS. 1 through 4 present a deployable inflatable life raft assembly 300 in accordance with one embodiment of the present invention. The life raft assembly 300 of the present embodiment comprises an inflatable deployable life raft 500 and a carrier 310. The carrier 310 is configured for storing the life raft 500 in a folded deflated state. The illustration of FIG. 1, in particular, shows the life raft assembly 300 in a closed or storage state in which the life raft 500 is deflated, folded and stored inside the carrier 310, and the carrier 310 is closed. The illustrations of FIGS. 2 and 3, in turn, show the life raft assembly 300 in state in which the carrier 310 has been opened. The illustration of FIG. 3 shows the deflated, folded life raft 500 stored inside the carrier 310. For clarity purposes, the illustration of FIG. 2 does not show the life raft 500. In turn, the illustration of FIG. 4 shows the life raft 500 being deployed from the carrier 310 and inflated. The life raft 500 can be reversibly and selectively altered from the deflated and folded configuration to the deployed and inflated configuration.

The carrier 310 is fabricated having a peripheral wall comprising a first pair of opposed sidewalls 312, and a second pair of opposed sidewalls 314, 316. The peripheral wall extends upward from a peripheral edge of a base or bottom sidewall 318, the sidewalls 312, 314, 316, 318, thereby forming a carrier life raft receptacle 319. The sidewalls 312, 314, 316, 318 of the present embodiment form a substantially rectangular carrier body, to facilitate the storage of the life raft 500 in a folded or pleated arrangement, as best shown in FIG. 3. A first cover flap 320 is foldably attached to an exposed edge of one sidewall 316. Similarly, a second cover flap 330 is foldably attached to an exposed edge of an opposite sidewall 314. The first cover flap 320 and second cover flap 330 are sized to overlap when placed into a folded configuration as shown in FIG. 1. The first cover flap 320 and second cover flap 330 include an overlap fastener 322 and an overlap mating fastener 332, respectively, to enable a quick releasing interface along a cover flap overlap 329. The overlap fastener 322 and overlap mating fastener 332 are preferably fabricated of a quick release attachment interface, such as a dense hook and loop tape (as illustrated), a series of snaps, one or more magnets, and the like. The quick release attachment interface enables release between the first cover flap 320 and the second cover flap 330 as the inflatable life raft 500 inflates. The overlap fastener 322 and overlap mating fastener 332 can be additionally supported along each of their edges by integrating a side flap 340 along the exposed edge of each of the carrier sidewalls 312. The side flaps 340 are foldable and attached to the carrier 310 along at least a portion of the exposed edge of each sidewall 312. The first cover flap 320, second cover flap 330 and side flaps 340 are hingeably attached to the respective sidewalls 316, 314, 312 in a manner that fully exposes an exposed peripheral of the carrier life raft receptacle 319 for unencumbered deployment of the inflatable life raft 500. A side flap edge fastener 344 is applied to a contacting surface of each side flap 340. Mating cover edge fasteners 324, 334 are provided along mating edges of the first and second cover flaps 320, 330 respectively. The cover edge fastener 324, cover edge fastener 334, and mating side flap edge fasteners 344 are preferably fabricated of a quick release attachment interface, such as a dense hook and loop tape (as illustrated), a series of snaps, one or more magnets, and the like. For consistency, the cover edge fastener 324, cover edge fastener 334, and mating side flap edge fasteners 344 are preferably fabricated of the same connection interface as the overlap fastener 322 and overlap mating fastener 332. The carrier 310 is preferably fabricated of a fabric, such as canvas, or other flexible material.

The inflatable life raft 500, in turn, is shown in a partially deployed configuration in FIG. 4. The inflatable life raft 500 of the present embodiment is fabricated having a plurality of longitudinal inflatable chambers 551 arranged parallel to one another. Preferably, several resilient flexible sheets are joined and sealed together along the outer edge or perimeter and along a plurality of longitudinal seams 553 to form the parallel inflatable chambers 551. It will be understood that single ply or multiply sheets may be sealed together using simple heat sealing methods, such as dielectric heating, sonic welding, ultrasonic welding, gluing, adhesively bonding, using vulcanization techniques or any other well know methods of joining and sealing rubberized or thermoplastic materials together. The plurality of longitudinal inflatable chambers 551 can be provided having a single air or gas retaining chamber or be divided into multiple air or gas retaining chambers; in other words, the longitudinal inflatable chambers 551 can be in fluid communication or not be in fluid communication. For instance, in the present embodiment, the longitudinal inflatable chambers 551 are in fluid communication, forming a single gas impervious chamber 510. In this unitary air or gas retaining chamber configuration, the inflatable life raft 500 only requires a single inflator valve 554 (best shown in FIG. 3). In the multiple chamber configuration, instead, the inflatable life raft 500 would require at least one inflator valve 554 per longitudinal inflatable chamber 551.

With continued reference to FIG. 4, at least one reflector 550 is attached to one or both surfaces of the inflatable life raft 500 (in the present embodiment, there are reflectors 550 on both surfaces of the inflatable life raft 500). In different embodiments, the reflectors 550 may be disposed anywhere on the upper and bottom surface of the life raft 500. It is preferred that each reflector 550 is securely positioned along the outer edge of the life raft so that a user does not cover the reflecting abilities of each reflector 550 when lying on the life raft 500. For example, reflectors 550 may be spatially arranged about the top and/or bottom surface of the inflatable life raft 500. The reflectors 550 can be located proximate each of the four corners of the inflatable life raft 500, at two corners of the inflatable life raft 500, in the middle of the inflatable life raft 500, opposite each other, or about a head or feet region of the inflatable life raft 500. Each reflector 550 is sized and shaped to optimally reflect light or radar signals from the life raft 500. The reflectors 550 may be fabricated using reflective tape, reflective plastic, a mirror-like mylar material, or a textile fabric material coated with a metallic material such as a reflective silver coating, metal foil, and the like. Additionally, each reflector 550 may comprise a radar reflector or any other reflective material that is detectable by radar. Radar reflectors 550 may be disposed about the top and/or bottom surface of the inflatable life raft 500 to allow the life raft 500 and user to be detected by radar from a boat or plane. Such radar reflectors 550 may include a laminated protective cover that is disposed over the reflective material to prevent the reflective material of each reflector 550 from being damaged or contaminated by water. The radar reflectors 550 can be located about the inflatable life raft 500 to reflect at different angles to increase the potential for reflecting a radar signal.

As can be seen in FIG. 4, the gas impervious chamber 510 of the present embodiment is fabricated including an outer edge flap 549 about a perimeter thereof. The outer edge flap 549 is preferably void of any chambers. A series of grommets 548 are attached to the outer edge flap 549, providing a reinforced passage for items such as a peripheral grab rope 560. The grommets 548 can be located at each of the four corners and at any location along the outer edge flap 549 therebetween. The peripheral grab rope 560 can be routed along either side (as illustrated) or completely around the entire periphery of the gas impervious chamber 510. A grab strap 570 can be attached to the outer edge flap 549 by an adhesive, stitching, rivets, grommets, and the like. The inflatable life raft 500 can include the peripheral grab rope 560, the grab strap 570 or both.

In the illustration of FIG. 4, the carrier 310 is presented retaining the original shape. The carrier 310 is presented in this manner to retain consistency and clarity throughout the application. It is understood that the carrier 310 will commonly deform during deployment of the inflatable life raft 500, often inverting. It is understood that the inflatable life raft 500 can be provided in any reasonable size, shape, or configuration to meet the desired needs of the user.

Figure 5:
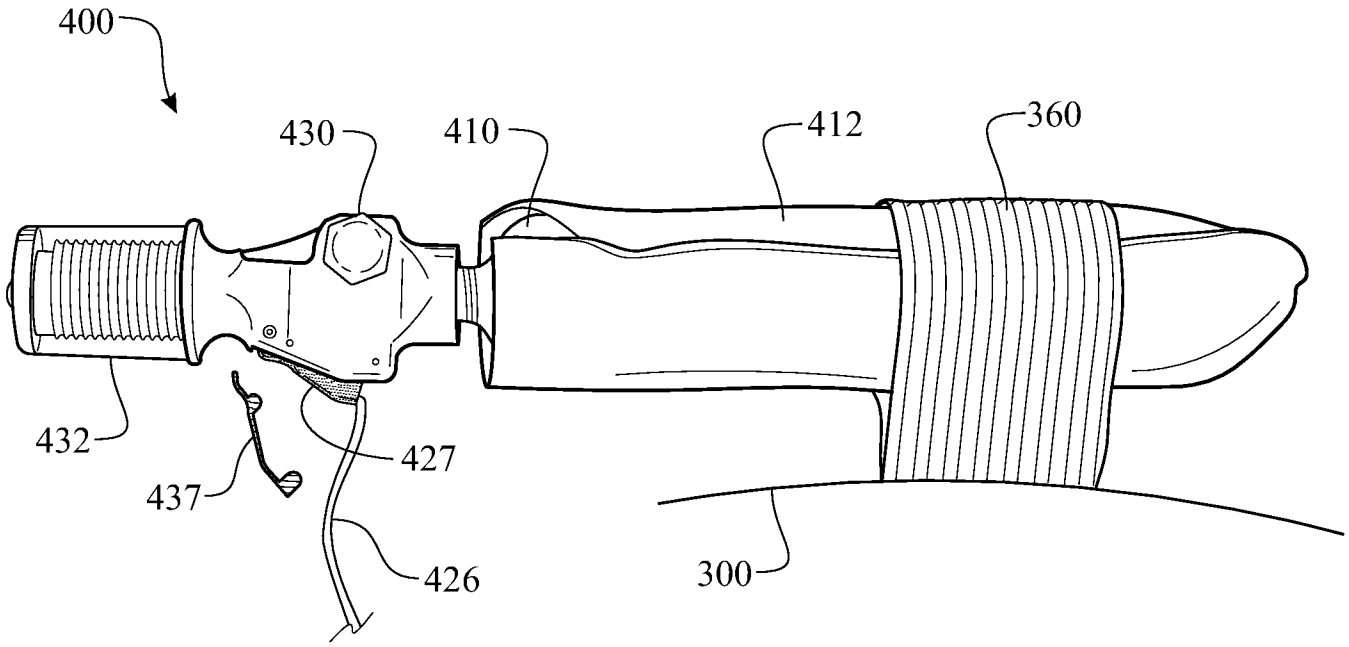
FIG. 5 presents an isometric view of an exemplary replaceable gas cylinder assembly comprised in the deployable inflatable life raft assembly of the previous figures.
Figure 6:
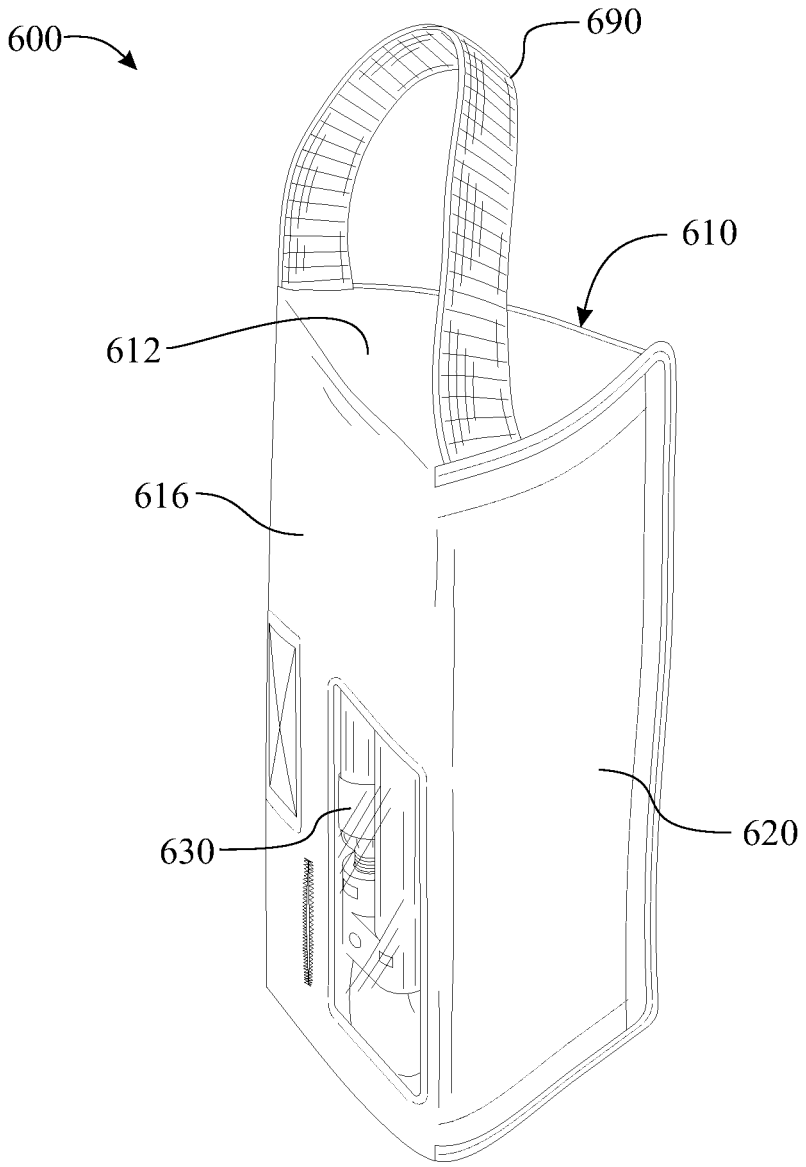
FIG. 6 presents a perspective view of a deployable inflatable life raft assembly in accordance with a second embodiment of the invention, the assembly being shown in a closed configuration in which the life raft is deflated, folded and stored inside the carrier.

In addition to the life raft 500, a replaceable gas cylinder assembly 400 is stored in the carrier 310 with little added weight. The replaceable gas cylinder assembly 400 is inserted into a cylinder sleeve 412 and secured within the carrier 310 by a gas cylinder retainer 360, as illustrated in FIG. 2 and detailed in FIG. 5. The replaceable gas cylinder assembly 400 includes a compressed gas cylinder 410 for storing pressurized air or gas in order to automatically inflate the life raft 500. The compressed gas cylinder 410 is sized to hold at least the requisite amount of air or gas that is needed to inflate the life raft 500, and preferably include at least some additional reserve air. A gas cylinder fill control assembly 430 can be removably attached to the compressed gas cylinder 410 for operational conveyance of the gas within compressed gas cylinder 410. The replaceable gas cylinder assembly 400 can include an air or gas fill indicator 432 to indicate the presence of pressurized air or gas within the compressed gas cylinder 410. A first end of a loader pull string 426 is attached to a valve within the gas cylinder fill control assembly 430 and a second end of the loader pull string 426 is attached to a cylinder actuating grip 428. A distal end of the loader pull string 426 is retained in location by a handle retention member 429 (best shown in FIG. 3). The cylinder actuating grip 428 is located external to the carrier life raft receptacle 319, providing quick and easy access of the cylinder actuating grip 428 to the user. The replaceable gas cylinder assembly 400 can release air or gas using a manual control valve or an automated control valve.

One exemplary operational control for the automated valve is a fill actuator 427. The fill actuator 427 pivots forward actuating the valve to release the gas from within the compressed gas cylinder 410, allowing the gas to transfer from the compressed gas cylinder 410 to the longitudinal inflatable chambers 551 (FIG. 4) of the inflatable life raft 500. A fill actuator status indicator 437 is clipped over the fill actuator 427 to indicate that the fill actuator 427 has been activated. The fill actuator 427 and fill actuator status indicator 437 are preferably fabricated in different colors, enabling visual inspection to determine whether the fill actuator 427 has been activated. For example, the fill actuator status indicator 437 can be fabricated having a green colored exterior and the fill actuator 427 can be fabricated having a red colored exterior. Green represents good (filled); red represents bad (exhausted). The replaceable gas cylinder assembly 400 is placed within the carrier 310 orienting the fill actuator status indicator 437 towards the cartridge viewing window 315 for ease of visual inspection. The replaceable gas cylinder assembly 400 and the inflatable life raft 500 are attached in fluid communication by a gas impervious conduit, such as a section of rubber tubing.

As shown in FIG. 2, when the life raft assembly 300 is in the storage position, the inflatable life raft 500 of the present embodiment is completely deflated, folded in an overlapping manner along a longitudinal direction, and finally folded in a pleated manner along a lateral direction. The inflatable life raft 500 is preferably folded in thirds longitudinally as illustrated in the figure. The compacted inflatable life raft 500 is placed within the carrier life raft receptacle 319 as illustrated in FIG. 3. Since the carrier 310 comprises a peripheral wall defining a receptacle 319, the life raft 500 can remain perfectly and safely stored within the carrier 310 in a folded/pleated manner. It is understood that the inflatable life raft 500 can include markings to aid the user in properly folding the inflatable life raft 500 into the desired finished size. Once the life raft 500 is folded and placed in the receptacle 319, the first cover flap 320 is folded, covering a portion of the open end of the carrier life raft receptacle 319. The first cover flap 320 can be secured in a closed configuration by engaging the cover edge fastener 324 and the mating side flap edge fastener 344. The second cover flap 330 is then folded, covering the remaining exposed portion of the open end of the carrier life raft receptacle 319. The second cover flap 330 is secured in a closed configuration by engaging the overlap mating fastener 332 and the overlap fastener 322. The second cover flap 330 can be additionally retained in a closed configuration by engaging the cover edge fastener 334 and the optional mating side flap edge fastener 344.

In operation, a user pulls the cylinder actuating grip 428, which causes the fill actuator 427 to pivot forward, actuating the valve to release the gas from within the compressed gas cylinder 410, allowing the pressurized gas to transfer from the compressed gas cylinder 410 to the longitudinal inflatable chambers 551 (FIG. 4) forming a single gas impervious chamber 510 of the inflatable life raft 500. As the gas impervious chamber 510 inflates, the life raft 500 begins pushing the first and second cover flaps 320, 330 and the side flaps 340, and eventually pushes strongly enough to cause the mating carrier fasteners 322, 332; 324, 334, 344 to unfasten and the carrier 310 to open up, allowing the life raft 500 to deploy from within the carrier 310 and finish inflating. At some point before, during or shortly after the deployment process, the user can attach the tether fastener 352 to their body. This ensures the life raft assembly 300 remains with the user until rescued or finished using the life raft assembly 300.

In accordance with the invention, the carrier 310 does not tear, rip or break when the life raft 500 inflates and deploys from within; instead, the carrier 310 remains re-usable, by means of the selectively engageable fasteners 322, 332; 324, 334, 344 which are configured to open before the carrier-forming sheets have a chance to be adversely affected by the expanding pressure exerted by the inflating life raft 500. In addition, the carrier 310 and the life raft 500 remain integrally or permanently attached once the life raft 500 has been fully inflated. In fact, the carrier 310 and the life raft 500 remain integral or permanently attached regardless of whether the life raft assembly 300 is in the storage configuration of FIG. 1, being deployed for use as shown in FIG. 4, or fully deployed and ready for use. After use, the replaceable gas cylinder assembly 400 or the compressed gas cylinder 410 can be replaced with a new assembly or cylinder, for subsequent inflation of the life raft 500. In alternative embodiments, a refillable gas cylinder assembly could be used instead of a replaceable gas cylinder assembly 400. In certain embodiments, the life raft assembly can comprise a manual air pump or manual air inlet for manually inflating the life raft 500.

The deployable inflatable life raft assembly 300 of the present embodiment includes several features to improve the functionality and comfort for the user. A carrier handle 390 is attached to the body of the carrier 310. The carrier handle 390 includes a handle grip 394 attached to the carrier 310 by a handle strap 392. A cartridge viewing window 315 can be integrated into the sidewall 314 adjacent to the replaceable gas cylinder assembly 400, enabling the user or other party the ability to visually inspect the deployable inflatable life raft assembly 300 to ensure the replaceable gas cylinder assembly 400 is properly filled. The life raft assembly 300 can include a tether for gripping the assembly or attaching it to a person's wrist, ankle or other body part; for instance, in the present embodiment, the tether comprises a tether fastener 352 and a tether removal grip 354 attached to a distal end of the tether fastener 352. A tether pocket 350 can be integrated into the deployable inflatable life raft assembly 300 to stow the tether at least partially; for example, FIG. 1 shows the tether fastener 352 partially housed in the tether pocket 350, such as the tether 57. The tether removal grip 354 aids the user in withdrawing the tether from the tether pocket 350. The tether removal grip 354 also retains the tether fastener 352 in a desired position, partially extending from the tether pocket 350.

Figure 11:
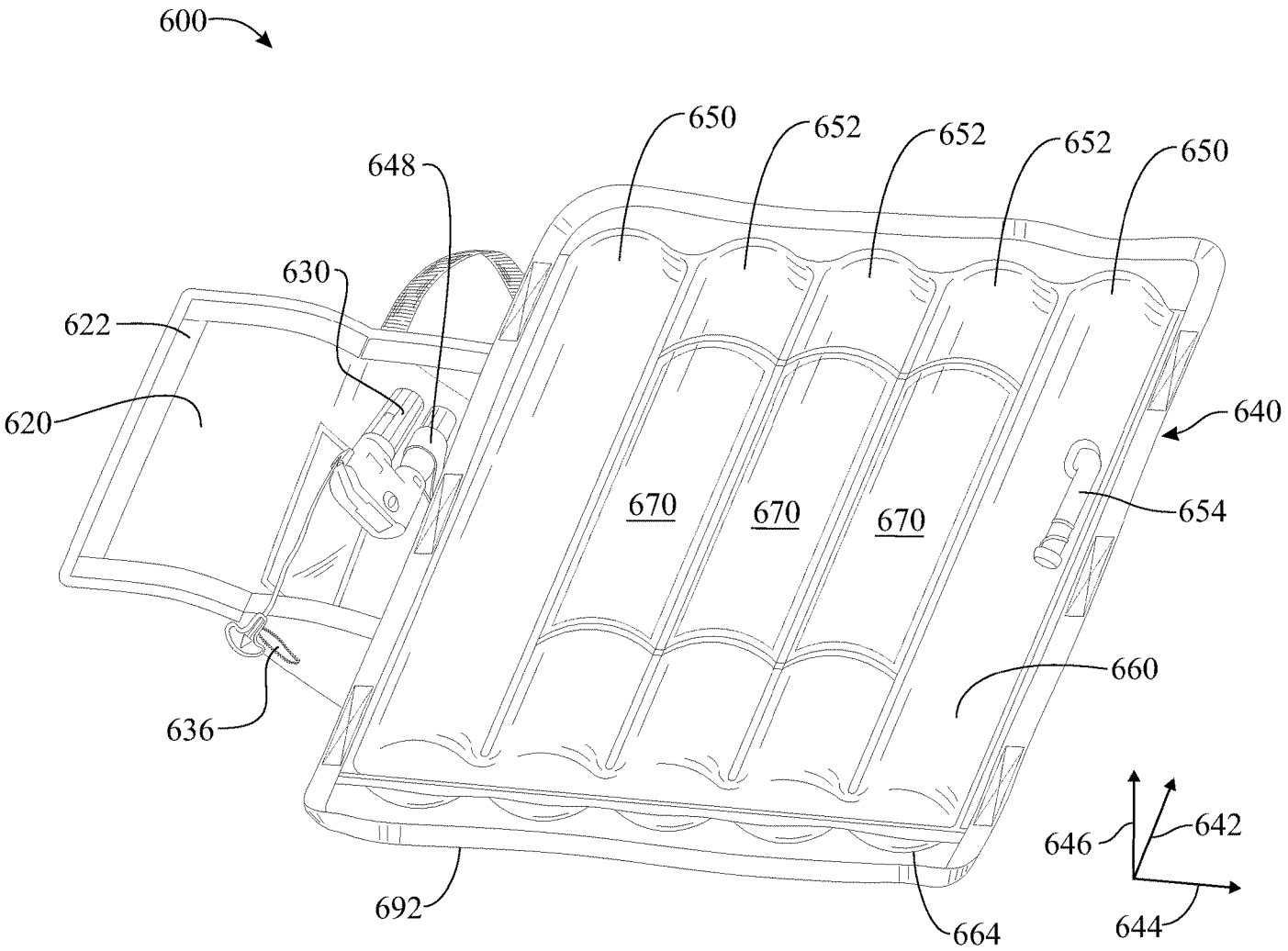
FIG. 11 presents another perspective view of the life raft assembly of FIG. 6, showing the life raft in a deployed, inflated configuration.
Figure 12:
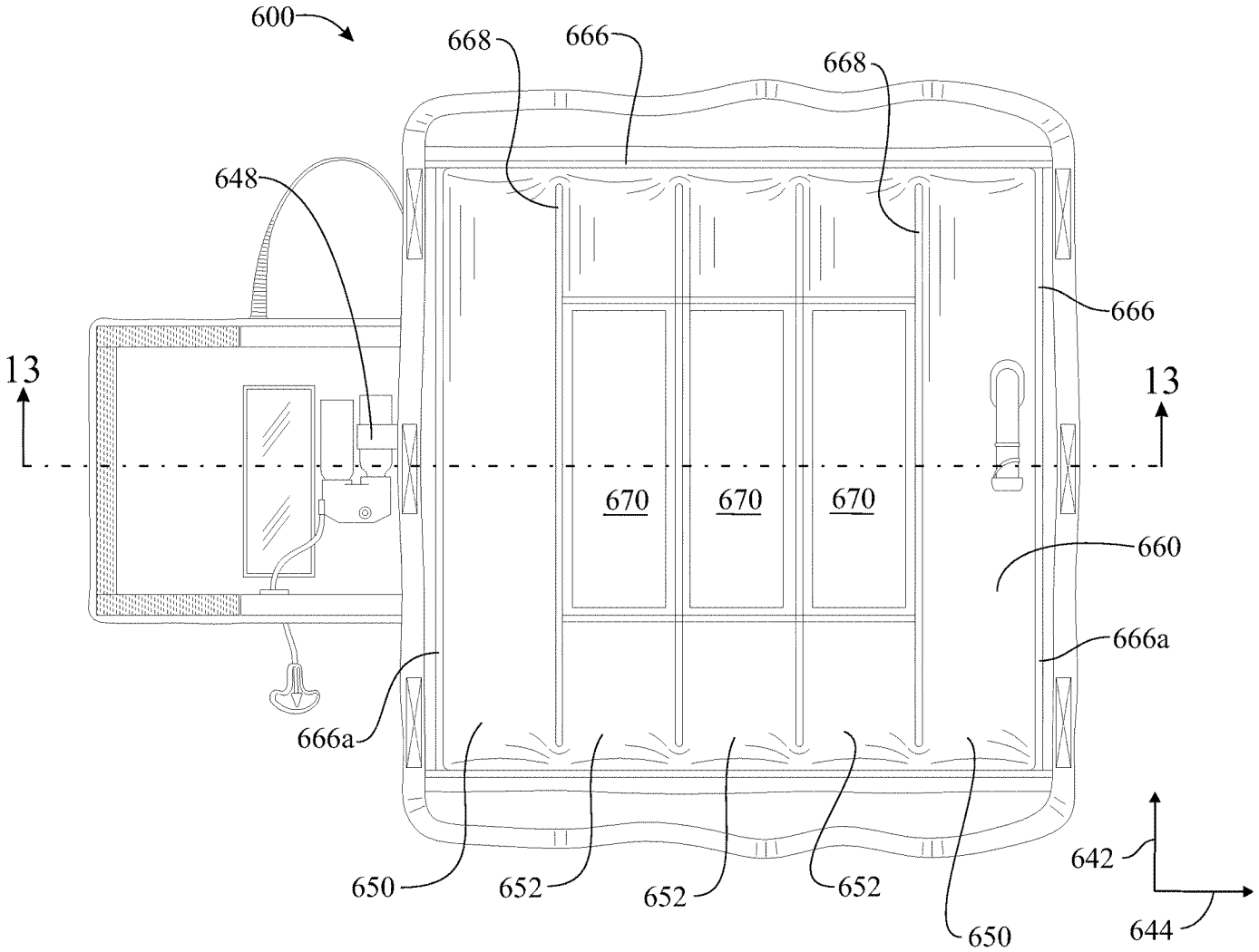
FIG. 12 presents a top plan view of the life raft assembly of FIG. 11.

The illustrations of FIGS. 6 through 13 present an inflatable life raft assembly 600 in accordance with a second embodiment of the invention, shown in different configurations and views illustrating an exemplary deploying and inflating sequence for preparing the life raft assembly 600 for use. Referring initially to FIGS. 11 and 12, the inflatable life raft assembly 600 comprises a storage carrier 610 and an inflatable life raft 640. The inflatable life raft 640 includes a plurality of chambers 650, 652 arranged in parallel configuration forming a generally rectangular shaped body when the life raft 640 is in a deployed and inflated configuration, as shown in FIGS. 11 and 12. In the present embodiment, the chambers 650, 652 are in fluid communication, forming a single gas impervious chamber which can be jointly inflated or deflated. The life raft 640 further includes at least one valve in fluid communication with the chambers 650, 652 for inflating and deflating the chambers 650, 652, as in the previous embodiment, the valve not being shown in the illustrations of the present embodiment. The inflatable life raft 640 is also elastic, and can be reversibly and selectively switched from the deployed and inflated configuration shown in the present figures to a deflated and folded configuration shown in FIG. 9. By "reversibly", it is understood that the life raft 640 can be switch from one confirmation to another, repeatedly, thus allowing the life raft assembly 600 to be reusable. By "selectively", it is understood that a user can select when to switch the life raft 640 from one configuration to another. The life raft 640 extends in a longitudinal direction 642 and a lateral direction 644 when arranged in the deployed and inflated configuration. The single gas impervious chamber formed by the chambers 650, 652 is configured to inflate and deflate in a transverse direction 646 perpendicular to the longitudinal and lateral directions 642, 644; for instance, the illustration of FIG. 11 shows the life raft 640 in a fully deployed and inflated configuration, in which the chambers 650, 652 have inflated and expanded in the transverse direction 646 relative to their deflated configuration shown in FIG. 10.

The storage carrier 610, in turn, is constructed integrally with or non-removably attached to a surface of the life raft body. By "integrally", it is understood that a part of the storage carrier 610 is manufactured in material and physical continuation of a part of the life raft 640, thereby forming an "integral" part. By "non-removably attached", it is understood that the storage carrier 610 is attached to the life raft 640 by heat welding, strong adhesive, stitching, sewing, stapling, riveting, or other permanent attachment not configured to be detached or disengaged by reasonably expected forces sustained by the life raft assembly 600 during normal use.

Figure 8:
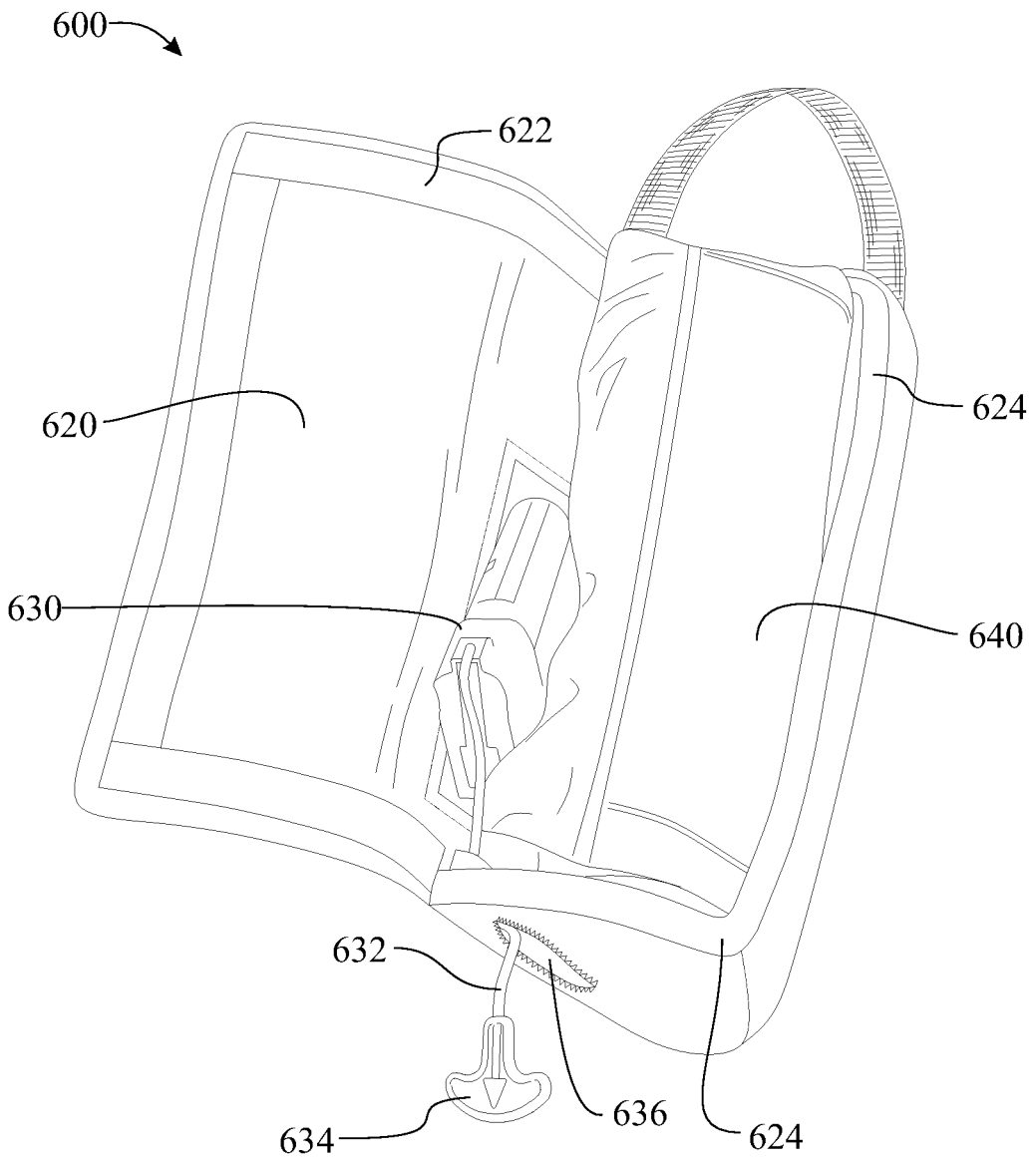
FIG. 8 presents a further perspective view of the life raft assembly of FIG. 6, having opened the closure flap to reveal the folded deflated life raft and the gas cylinder.
Figure 9:
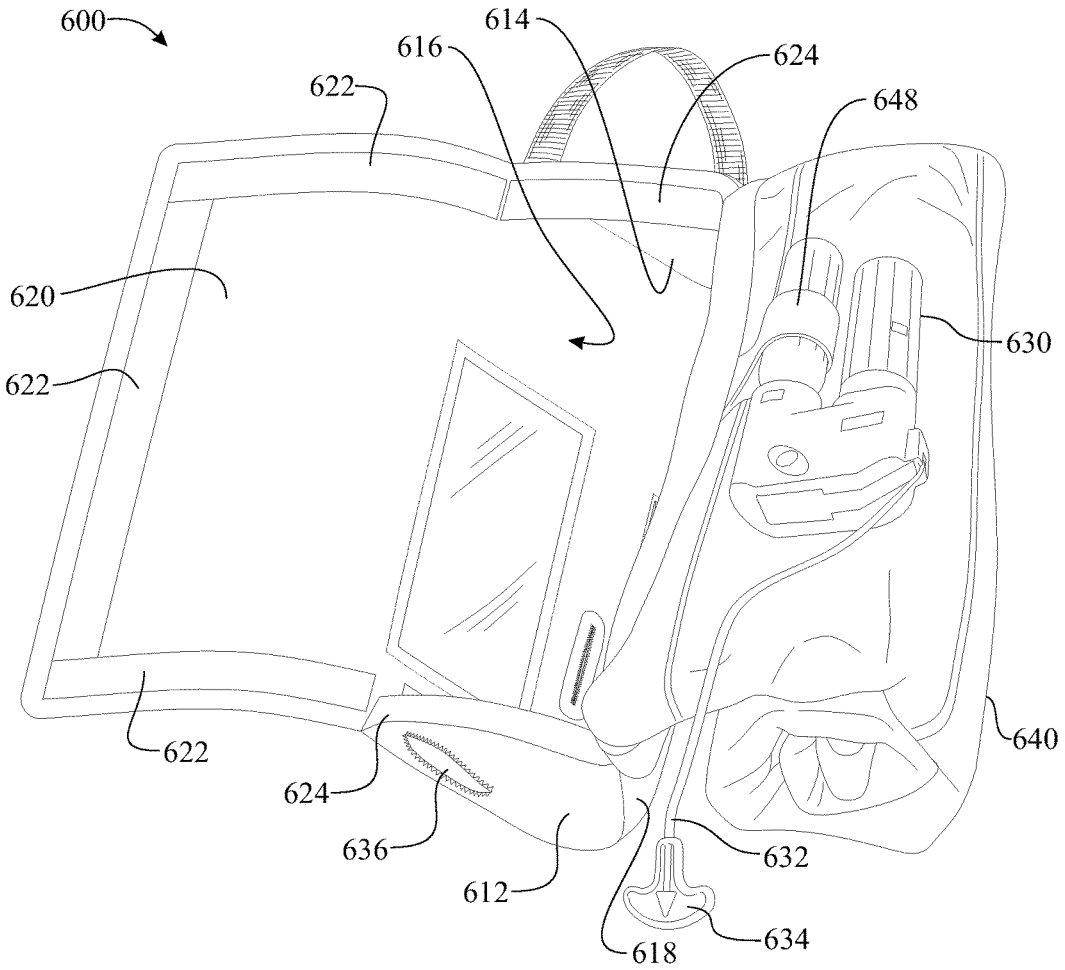
FIG. 9 presents a further perspective view of the life raft assembly of FIG. 6, having extracted the folded deflated life raft from the carrier, the carrier remaining attached to the life raft.
Figure 10:
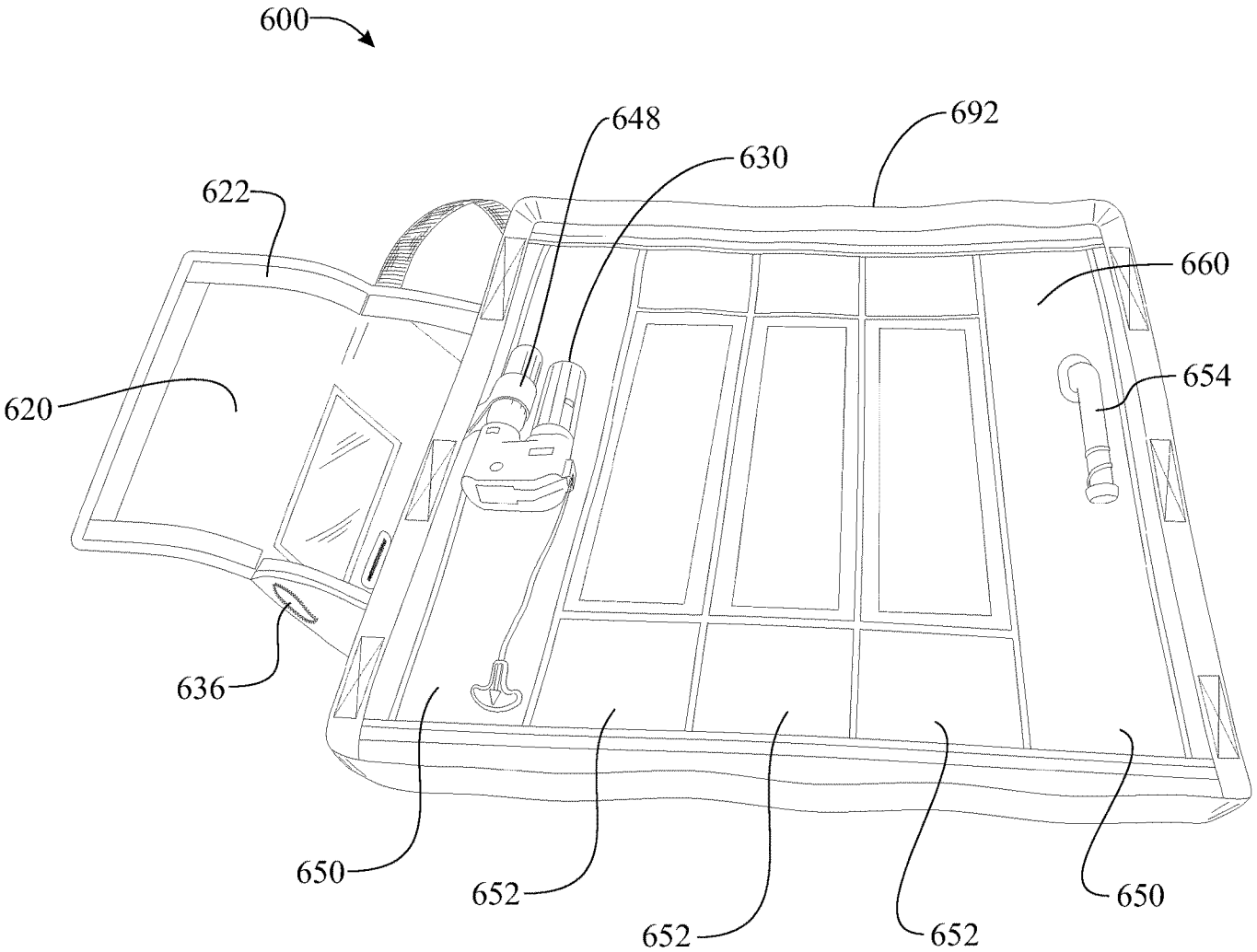
FIG. 10 presents another perspective view of the life raft assembly of FIG. 6, showing the life raft in a deployed, deflated configuration.

The storage carrier 610 of the present embodiment comprises a plurality of sidewalls 612, 614, 616, 618 delimiting a receptacle 619. Sidewalls 616, 618 are integrally formed and arranged in a substantially V-shaped configuration having a curved transition between them. Sidewalls 612, 614 are arranged non-coplanar to sidewalls 616, 618 and forming a generally right angle with the sidewalls 616, 618, at opposite ends of the V-shaped arrangement of sidewalls 616, 618. The end sidewalls 612, 614 are sewn to sidewalls 616, 618. A three-dimensional receptacle 619 is thereby formed, which is configured to store the inflatable life raft 640 in the deflated and folded configuration, as best shown in FIG. 8. The carrier 610 of the present embodiment further includes a handle 690, to facilitate storage and transportation of the life raft assembly 600, and to facilitate throwing or tossing the life raft assembly 600 in the storage configuration shown in FIG. 6. The life raft 640 further includes a peripheral grab strap 692 sewn at or near an outer perimeter 666 of the sheets 660, 664.

Figure 7:
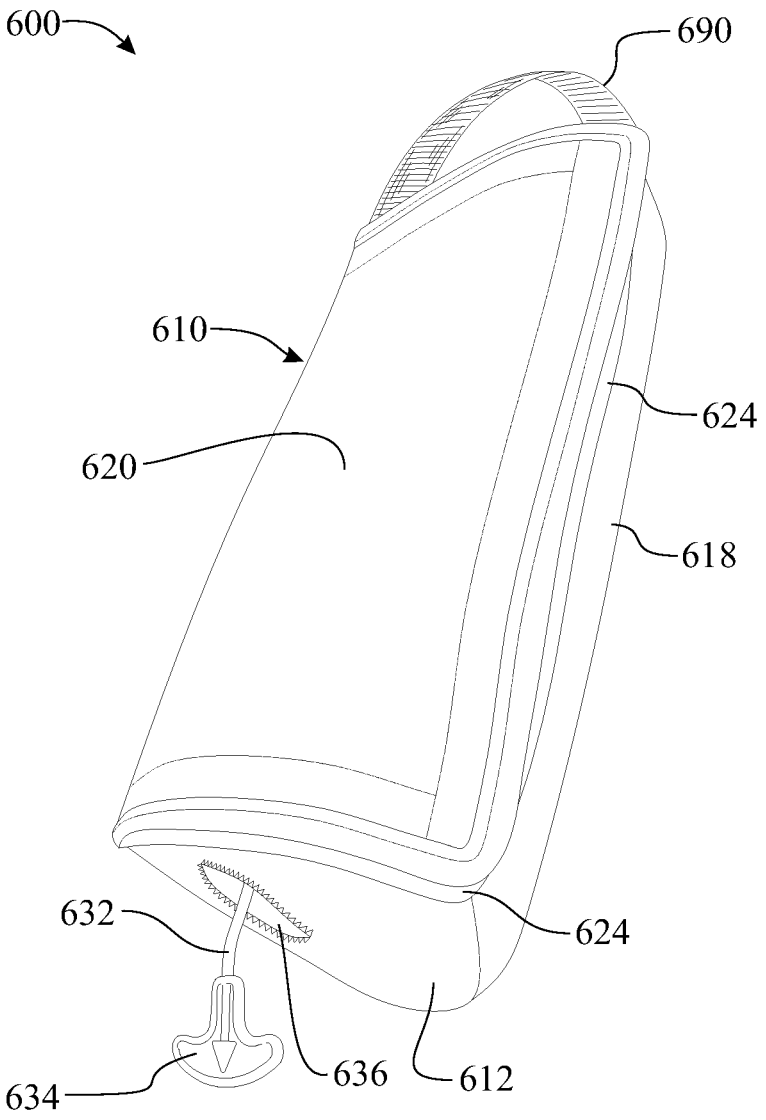
FIG. 7 presents another perspective view of the life raft assembly of FIG. 6, showing the closure flap in a closed and attached position.

In addition, the storage carrier 610 comprises at least one closure flap 620 extending from one or more sidewalls of the carrier 610; more specifically, the carrier 610 of the present embodiment includes a single storage flap 620 integrally formed and hingeably extending from one sidewall 616. The closure flap 620 selectively and reversibly prevents or provides access to the receptacle 619. At least one fastener 622, 624 is comprised in the storage carrier 610 for removably securing the closure flap 620 in a closed position, as shown in FIG. 7, in which access to the receptacle 619 is prevented. Normally, at least one fastener 622 is comprised on the closure flap 620, and at least one mating fastener 624 is provided on the carrier sidewalls 612, 614. In different embodiments of the invention, the closure flap fasteners can include at least one of a spring clip, zipper, buckle, strap, cord, hooks, clasps, carabiner, or any combination thereof. In a particularly advantageous embodiment, the closure flap fasteners 622, 624 are configured to unfasten upon a pressure exerted on the storage carrier 610 by the life raft 640 from within the receptacle when the life raft 640 is inflating from the deflated and folded configuration of FIG. 7. The life raft assembly 600 is thus capable of automatically opening the storage carrier 610 and deploying the life raft 640 when selected by a user. Such ability to automatically open the storage carrier closure flap 620 is achieved, for instance, by closure flap fasteners such as a hook and loop fastener, a snap fastener, a magnet, a quick release fastener, or a combination thereof. For instance, the present embodiment comprises hook-and-loop-type fasteners 622, 624.

In order to cause the life raft 640 to inflate, the life raft assembly 600 of the present embodiment comprises a compressed gas cylinder 630, preferably attached to the life raft 640, for instance by a tight strap 648. The compressed gas cylinder 630 is in selective fluid communication with the inflatable chambers 650, 652, and includes an actuating cord 632 terminated in an actuating grip 634 on which a user can pull in order to activate gas injection from the compressed gas cylinder 630 into the chambers 650, 652. Preferably, the actuating cord 632 and grip 634 protrude outwardly from the carrier 610 through a carrier opening 636 on a carrier sidewall 612. In certain embodiments, the life raft can further include a manual air pump and/or manual inflator, also in selective fluid communication with the chambers 650, 652 for allowing the user to manually inflate life raft 640. For instance, in the present embodiment, the life raft 640 includes a manual inflator 654 in selective fluid communication with the chambers 650, 652.

Figure 13:
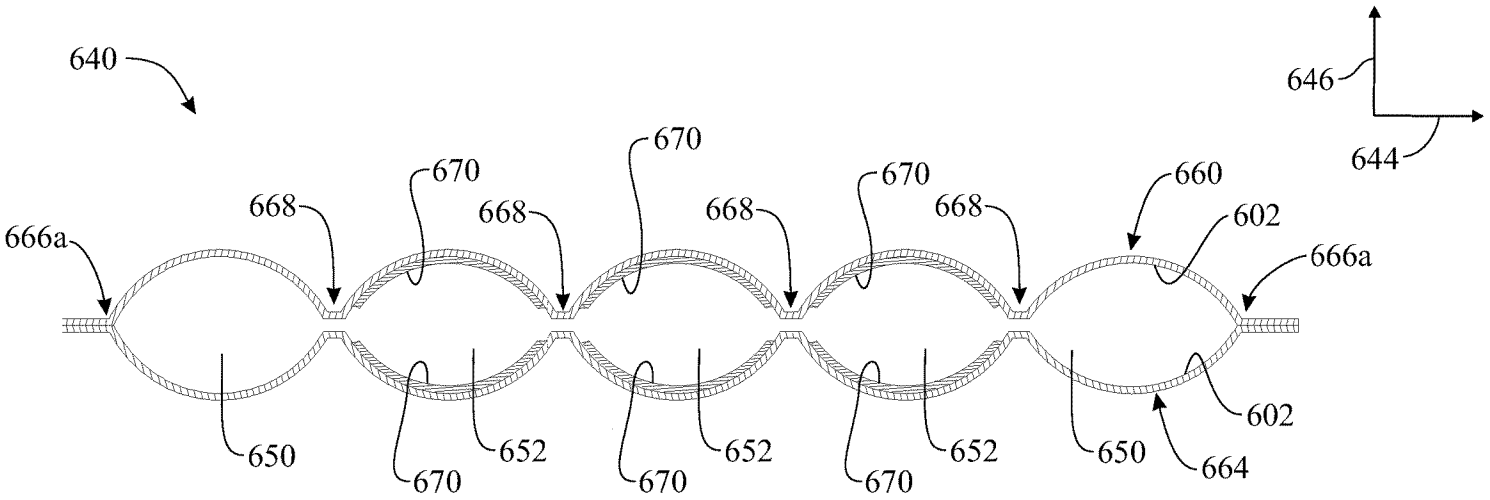
FIG. 13 presents a cross-sectional side elevation view of the inflated life raft of FIG. 12, the section taken along line 13-13.

The inflatable life raft 640 of the present embodiment is formed by two flexible sheets 660, 664, as shown in the cross-sectional view of FIG. 13. In alternative embodiments, the number of sheets could vary, such as by having each sheet 660, 664 comprised of several adjacent sheets or layers. The sheets 660, 664 are joined and sealed together along the outer perimeter 666 and along a plurality of seams 668. The seams 668 are arranged in the longitudinal direction 642, to facilitate folding (folding understood to encompass pleating, rolling or the like) and unfolding of the life raft 640 in the lateral direction 644. Two end chambers 650 are formed between respective opposite portions **666*a* of said outer perimeter 666 and a respective adjacent seam 668; several intermediate chambers 652, in turn, are formed between adjacent seams 668. The inflatable life raft 640 further comprises at least one weight insert 670 formed as a generally rectangular sheet portion in transverse alignment with a chamber. By "transverse alignment" it is understood that the weight insert 670 is aligned with a chamber in the transverse direction 646. The weight inserts 670 may be manufactured from PVC, vinyl, or other flexible material capable of providing notable added weight to the life raft 640 while still allowing the life raft 640 to fold and unfold. The weight inserts 670 can be either embedded within sheet layers or adjacent sheets, or externally or internally adhered to at least one sheet; for instance, in the present embodiment, as shown in FIG. 13, the weight inserts 670 are internally adhered, i.e., adhered to an inner surface 662 of both sheets 660, 664. The weight inserts 670 provide added weight to the life raft assembly 600, making it more capable of being thrown in a straight and precise trajectory, with a high chance of reaching the desired target (e.g., a drowning person), regardless of whether the life raft assembly 600 is deployed and inflated, or folded and deflated. When the life raft 640 is deployed and inflated, the weight inserts 670 reduce the effect of air friction against the life raft 640 when thrown, contributing to maintain the life raft's aimed parabolic trajectory when thrown towards a target in an already-deployed state. In consequence, a user can first deploy the life raft 640 and then throw the life raft assembly 600 to a person in need of assistance, with a high chance of reaching the target; the person in need of assistance can then directly grasp the life raft 640 without having to worry about pulling the actuating grip 634 to deploy the life raft 640. Those skilled in the art will recognize the advantages of such usage, given how difficult it is to carry out any kind of manual operation while hardly floating in water and having a hard time to stay calm. Thus the weight inserts 670** can greatly contribute to save people's lives.

In the present embodiment, in particular, the life raft 640 comprises weight inserts 670 arranged in transverse alignment with the intermediate chambers 652. The end chambers 650 are devoid of transversely-aligned weight inserts. Such an arrangement facilitates folding, unfolding, rolling, unrolling, pleating or unpleating of the life raft 640 in the lateral direction, to and from the carrier 310 (and, especially, facilitates rolling and unrolling, which is perhaps the most convenient and quick way of preparing the deflated life raft 640 for storage).

Figure 14:
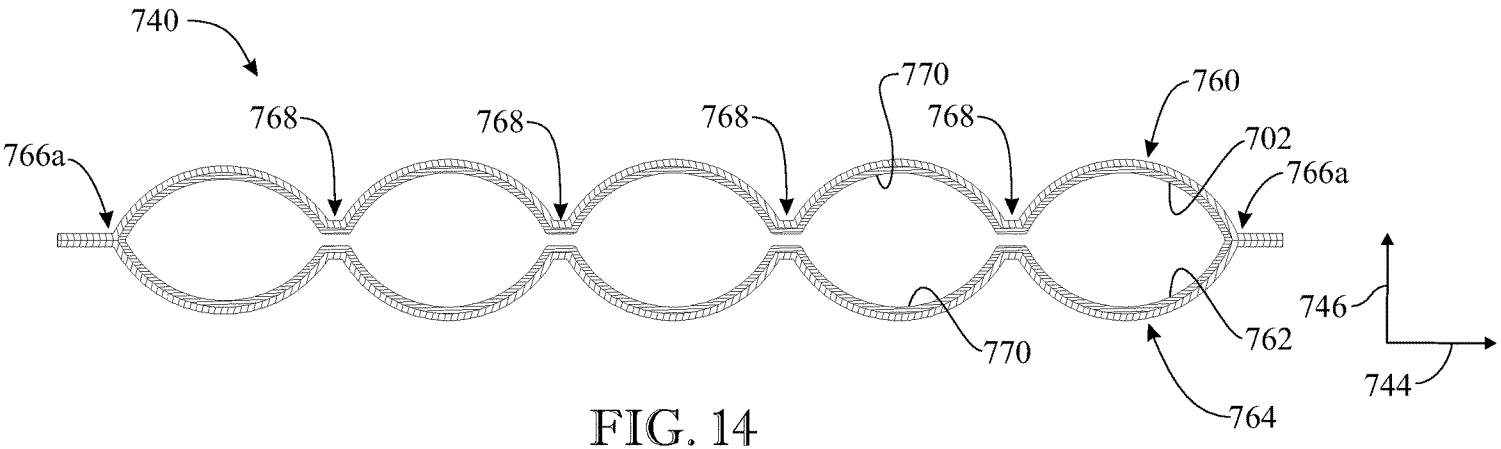
FIG. 14 presents a cross-sectional side elevation view of an inflated life raft, in accordance with a third embodiment of the present invention.

The illustration of FIG. 14 shows an alternative embodiment of the invention, and particularly of a life raft 740 comprised in a life raft assembly. Like features of the life raft 740 of FIG. 14 and the life raft 640 of FIGS. 7 through 13 are numbered the same except preceded by the numeral '7'. Specifically, as shown in FIG. 14, the life raft 740 comprises two flexible sheets 760, 764 joined and sealed together along an outer perimeter 766 and along a plurality of longitudinal seams 768. The life raft 740 further includes additional weighted sheets 770 having a greater weight than the weight of each of the remaining flexible sheets 760, 764. The weighted sheets 770 of the present embodiment are adjacent to an inner surface 762 of sheets 760, 764, and are attached to the sheets 760, 764 at the seams 768 and outer perimeter of the life raft 740 (the opposite outer portions 766*a* of said outer perimeter being shown in the figure). The heavier, weighted sheets 770 can be manufactured from a denser material than the flexible sheets 760, 764, and/or with a greater thickness than the flexible sheets 760, 764. In consequence, the weighted sheets 770 provide an increased weight to the life raft 740, and allow it to be thrown very precisely and to/from a greater distance.

The sheets and weight inserts in accordance with the present invention can be fabricated from a resilient material composed of any one of a thermoplastic material, vinyl, polyethylene, plastic, vinyl plastic such as vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

It is understood that any of the features presented in the embodiments may be integrated into any of the other embodiments.

The inflatable life raft of the present invention may be constructed to include an inflatable boat, mattress, bed, or any other suitable inflatable life raft used for recreation or personal safety. As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but defined in accordance with the foregoing claims appended hereto and their equivalents.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An inflatable life raft assembly comprising:

an inflatable life raft, comprising:

a plurality of chambers arranged in parallel configuration forming a generally rectangular shaped body when said life raft is in a deployed and inflated configuration, wherein said body can be reversibly altered from a deflated and folded configuration to said deployed and inflated configuration, and at least one valve in fluid communication with said chambers for inflating and deflating said chambers;

a tether connected to said body, said tether comprising a tether attachment to a user, said tether further comprising a tether strap, one end of said tether strap attached to said body, and a second end of said tether strap attached to an attachment for removably attaching said tether on a user's body part; and a storage carrier constructed integrally with or non-removably attached to a surface of said body, said storage carrier comprising:

a plurality of sidewalk delimiting a receptacle, said receptacle being configured to store said inflatable life raft body in said deflated and folded configuration;

at least one closure flap extending from a sidewall for selectively preventing or providing access to said receptacle, and at least one fastener for selectively and removably securing said closure flap in a closed position in which access to said receptacle is prevented.

2. The life raft assembly of claim 1, wherein said storage carrier further comprises a handle.

3. The life raft assembly of claim 1, wherein said fastener includes at least one of a spring clip, zipper, buckle, strap, cord, hooks, clasps, carabiner, or any combination thereof.

4. The life raft assembly of claim 1, wherein said at least one fastener is configured to unfasten upon a pressure exerted on said storage carrier by said life raft from within the receptacle when said life raft is inflating from said deflated and folded configuration.

5. The life raft assembly of claim 1, wherein said at least one fastener comprises at least one of a hook and loop fastener, a snap fastener, a magnet, a quick release fastener, or a combination thereof.

6. The life raft assembly of claim 1, wherein said life raft is fabricated from a resilient material composed of any one of a thermoplastic material, vinyl, polyethylene, plastic, vinyl plastic, vinyl chloride, vinyl acetate, polyester fabric coated with plastic, a fabric coated urethane, rubberized nylon, polypropylene, rubber, PVC, polyurethane, or neoprene, canvass, vinyl/canvass, or any combination thereof.

7. The life raft assembly of claim 1, further including at least one reflector disposed on at least one side of said body, wherein said reflector is arranged closer to an edge of said side than to a center of said side.

8. The life raft assembly of claim 1, wherein said life raft includes a plurality of grommets disposed along an outside perimeter flap of said life raft.

9. The life raft assembly of claim 1, wherein said life raft further includes a gas cylinder in selective fluid communication with said chambers.

10. The life raft assembly of claim 1, wherein said life raft further includes a manual air pump and/or manual inflator, in selective fluid communication with said chambers for manually inflating said life raft.

11. The life raft assembly of claim 1, wherein said inflatable life raft body comprises at least one weight insert arranged in transverse alignment with a chamber.

12. An inflatable life raft assembly comprising:

an inflatable and flexible life raft, reversibly and selectively alterable from a deflated and folded configuration to a deployed and inflated configuration, said life raft extending in longitudinal and lateral directions when in said deployed and inflated configuration, said life raft comprising:

at least one gas impervious chamber configured to inflate and deflate in a transverse direction perpendicular to said longitudinal and lateral directions;

at least one valve in fluid communication with said at least one gas impervious chamber for inflating and deflating said at least one chamber; and at least one weight insert arranged in transverse alignment with said chamber;

a storage carrier constructed integrally with or non-removably attached to a surface of said inflatable life raft, said storage carrier comprising:

a plurality of sidewalls delimiting a receptacle, said receptacle being configured to store said inflatable and flexible life raft in said deflated and folded configuration;

at least one closure flap extending from a sidewall for selectively preventing or providing access to said receptacle, and at least one fastener for selectively and removably securing said closure flap in a closed position in which access to said receptacle is prevented.

13. The life raft assembly of claim 12, wherein the life raft comprises at least two flexible sheets joined and sealed together along an outer perimeter and along a plurality of longitudinal seams, end chambers being formed between a respective opposite portions of said outer perimeter and a respective adjacent seam, and intermediate chambers being formed between seams, wherein at least one weight insert is formed as a generally rectangular sheet portion embedded or adhered to at least one flexible sheet, in transverse alignment with a chamber.

14. The life raft assembly of claim 13, wherein all weight inserts are formed as generally rectangular sheet portions embedded or adhered to at leak one flexible sheet, in transverse alignment with a chamber.

15. The life raft assembly of claim 12, wherein the life raft comprises at least two flexible sheets joined and sealed together along an outer perimeter and along a plurality of longitudinal seams, end chambers being formed between a respective opposite portions of said outer perimeter and a respective adjacent seam, and intermediate chambers being formed between seams, wherein said weight inserts are arranged in transverse alignment with said intermediate chambers, said end chambers being devoid of transversely-aligned weight inserts.

16. The life raft assembly of claim 12, wherein the life raft comprises at least two flexible sheets joined and sealed together along an outer perimeter and along a plurality of longitudinal seams, wherein at least one flexible sheet presents a higher density than a density of the rest of flexible sheets.

17. An inflatable life raft assembly comprising:

an inflatable life raft, comprising:

a plurality of chambers arranged in parallel configuration forming a generally rectangular shaped body when said life raft is in a deployed and inflated configuration, wherein said body can be reversibly altered from a deflated and folded configuration to said deployed and inflated configuration, and at least one valve in fluid communication with said chambers for inflating and deflating said chambers;

at least one reflector disposed on at least one side of said body, wherein said reflector is arranged closer to an edge of said side than to a center of said side; and a storage carrier constructed integrally with or non-removably attached to a surface of said body, said storage carrier comprising:

a plurality of sidewalls delimiting a receptacle, said receptacle being configured to store said inflatable life raft body in said deflated and folded configuration;

at least one closure flap extending from a sidewall for selectively preventing or providing access to said receptacle, and at least one fastener for selectively and removably securing said closure flap in a closed position in which access to said receptacle is prevented.

18. An inflatable life raft assembly comprising:

an inflatable life raft, comprising:

a plurality of chambers arranged in parallel configuration forming a generally rectangular shaped body when said life raft is in a deployed and inflated configuration, wherein said body can be reversibly altered from a deflated and folded configuration to said deployed and inflated configuration, at least one valve in fluid communication with said chambers for inflating and deflating said chambers, and a plurality of grommets disposed along an outside perimeter flap of said life raft; and a storage carrier constructed integrally with or non-removably attached to a surface of said body, said storage carrier comprising:

a plurality of sidewalls delimiting a receptacle, said receptacle being configured to store said inflatable life raft body in said deflated and folded configuration;

at least one closure flap extending from a sidewall for selectively preventing or providing access to said receptacle, and at least one fastener for selectively and removably securing said closure flap in a closed position in which access to said receptacle is prevented.

19. An inflatable life raft assembly comprising:

an inflatable life raft, comprising:

a plurality of chambers arranged in parallel configuration forming a generally rectangular shaped body when said life raft is in a deployed and inflated configuration, Wherein said body can be reversibly altered from a deflated and folded configuration to said deployed and inflated configuration, and at least one valve in fluid communication with said chambers for inflating and deflating said chambers;

a tether connected to said body, said tether comprising a tether attachment to a user; and a storage carrier constructed integrally with or non-removably attached to a surface of said body, said storage carrier comprising:

a plurality of sidewalls delimiting a receptacle, said receptacle being configured to store said inflatable life raft body in said deflated and folded configuration;

at least one closure flap extending from a sidewall for selectively preventing or providing access to said receptacle, and at least one fastener for selectively and removably securing said closure flap in a closed position in which access to said receptacle is prevented; wherein said inflatable life raft body comprises at least one weight insert arranged in transverse alignment with a chamber.

* * * * *